United States Patent [19]

Youngblood et al.

[11] Patent Number: 4,578,970

[45] Date of Patent: Apr. 1, 1986

[54] PORTABLE, REMOVABLE, DOOR KNOB MOUNTED, DOOR LOCKING APPARATUS

[76] Inventors: Dennis L. Youngblood, 140 Chimney La., Haughton, La. 71037; Fred L. Ordelheide, #4 Twin Point Dr., Benton, La. 71006

[21] Appl. No.: 594,743

[22] Filed: Mar. 29, 1984

[51] Int. Cl.[4] ..... E05B 17/14

[52] U.S. Cl. ..... 70/428; 70/209

[58] Field of Search ..... 70/207, 209, 210, 211, 70/416, 423, 424, 425, 426, 427, 428; 292/DIG. 2

[56] References Cited

U.S. PATENT DOCUMENTS

| | | | |
|---|---|---|---|
| 1,439,552 | 12/1922 | Johnson | 70/424 |
| 2,461,676 | 2/1949 | Budak | 70/416 |
| 3,210,972 | 10/1965 | Johnson | 70/211 |
| 3,623,346 | 11/1971 | Curtin | 70/424 |
| 3,952,564 | 4/1976 | Maines | 70/424 |
| 4,007,956 | 2/1977 | Harris | 292/DIG. 2 |
| 4,503,692 | 3/1985 | Grint | 292/DIG. 2 |

*Primary Examiner*—Robert L. Wolfe

[57] ABSTRACT

This invention provides a method and apparatus for preventing an ordinary door knob from being rotated, thus preventing the plunger-type bolt from disengaging from the striker plate and plunger pocket in the door jamb. The apparatus is attached to the shaft of the door knob on the deepest side of the door jamb. Once secured in place by the locking mechanism, enclosing all but the shaft of said door knob, its shape and design will prevent any effective rotation of the apparatus, or the door knob, due to its proximity to the door jamb nearest the door knob.

2 Claims, 3 Drawing Figures

PORTABLE, REMOVABLE, DOOR KNOB MOUNTED, DOOR LOCKING APPARATUS

BACKGROUND OF THE INVENTION

The pursuit of means to insure personal safety and protect personal property has generated a great need for improved security measures. While inumerable advances and improvements have been made in this field, there are conditions that exist on a large scale where these measures and devices fall short. As only a single example, not to be construed as the only application for this apparatus, a typical hotel or motel room door will usually have one or two locking closure devices. Although one key is given to the registered occupant, other keys have been "lost" or taken by previous occupants through oversight or design. Master keys made available to cleaning and maintenance staff are also frequently lost, stolen, or sold. Keys that are unaccounted for do not result in the locks being changed, so there is little change that the current occupant can control access and entry. In the face of these facts it is easily seen by this one example, that no matter how many locks and deadbolts are present, their effectiveness in any situation similar to the one outline above is far short of acceptable. This inventon will provide discreet personal control over the access and entry to a room regardless of the availability of other authorized or unauthorized keys.

SUMMARY OF THE INVENTION

This present invention provides a method and apparatus for "locking" a door knob and bolt closure device, regardless of the presence of any other door locks. It functions equally well on a passage (non-locking) door knob and bolt closure device, or a "lockset" (locking) door knob and bolt closure device. Another feature of this apparatus is that while it is attached to the shaft of the knob on the deepest side of the door jamb (which in most cases is the outside of the door) it will in no way affect the operation and rotation of the knob and release of the bolt from the opposite side (inside) of the door. This makes the invention equally effective in preventing opening the door from the outside regardless of whether or not anyone is inside the room.

BRIEF DESCRIPTION OF THE DRAWINGS

Referring now to the drawings which only show one example of apparatus in accordance with the present invention.

METHOD OF CONSTRUCTION AND OPERATION

Figure 2:
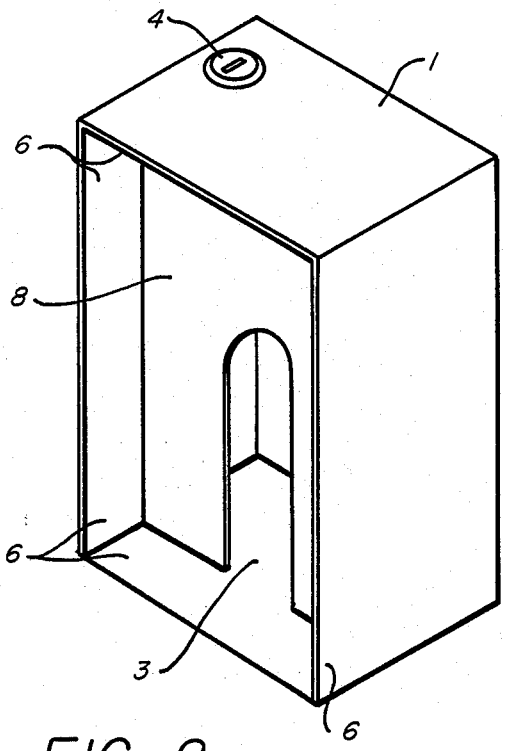
FIG. 2 shows a perspective view of the INNER PIECE from the side that is next to the door after installation on the knob.
Figure 1:
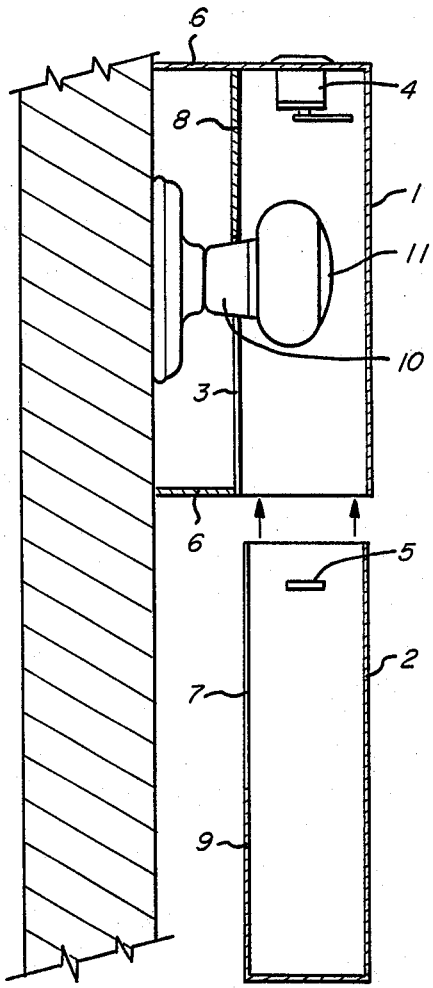
FIG. 1 shows a perspective view of the OUTER PIECE from the side that is next to the door after installation on the knob.
Figure 3:
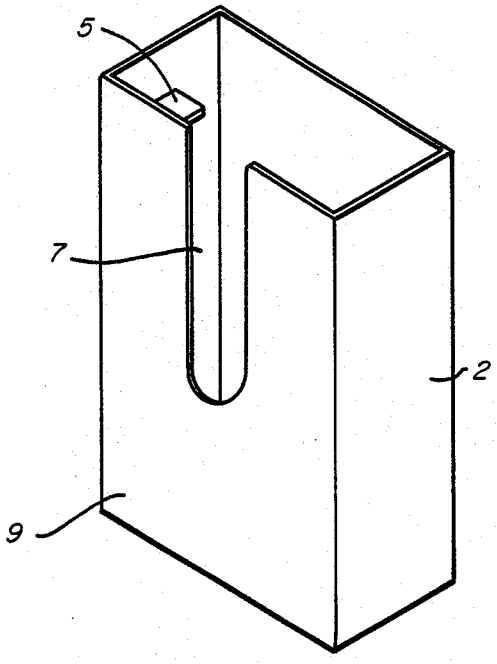
FIG. 3 is a cross-sectional view of the OUTER PIECE installed on the door knob and the INNER PIECE in place to be nested into the OUTER PIECE and locked in place. In describing the preferred embodiment of the invention illustrated in the drawings, specified terminology will be resorted to for the sake of clarity. However, it is not intended to be limited to the specific term so selected and it is to be understood that each specific term includes all technical equivalents which operate in a similar manner to accomplish a similar purpose.

Referring now more particularly to the drawings, the door knob guard is formed by the nesting, one inside the other, of outer part 1 and inner part 2, both being generally rectangular in shape and constructed of metal or other suitably strong, rigid, and malleable materials that can be permanently formed into the desired shape and design for the parts of this invention. Slots 3 and 7, in back wall 8 of outer part 1 and back wall 9 of inner part 2, respectively, are of a size and shape that will allow the movement of outer part 1 and inner part 2 up and down respectively over door knob shaft 10 with door knob 11 inside, to a totally nested position, leaving an opening at the rear of said door knob guard for shaft 10 of door knob 11, on which the invention is finally mounted and locked in place. Removal is effected by unlocking and sliding the components apart.

Lock and key mechanism 4, in the preferred embodiment, is a rotating arm type lock, mounted in outer part 1, and which rotates under the tab 5, such being an integral part of inner part 2, to thus lock outer part 1 and inner part 2 in the nested position. Once outer part 1 and inner part 2 are locked together, the invention is rectangular and box-like and solid on six sides except for the opening around the door knob shaft.

Flanges 6, extending past back 8 on outer part 1, serve to compensate for the slight variations in the length of the shafts on various types of door knobs. The purpose of these flanges 6 is to keep the space (and therefore access to the door knob shaft) between the rear of the invention and the face of the door as small as possible under a variety of conditions.

The door knob guard is effective as described above, but when in place it also provides a visible and genuine deterrent against unauthorized access and entry, and prevents the rotation of said knob and shaft sufficiently to retract the plunger type bolt from the striker plate and plunger pocket in the door jamb. The rotation is prevented due to the proximity of the door knob guard to the door jamb nearest said door knob. This apparatus is designed to be easily installed and removed and not affected by the presence or absence of any other locking closure devices on said door.

We claim:

1. A door knob guard, comprising:

a generally rectangular inner part nested inside a generally rectangular outer part, said inner and outer parts having a slot in the back walls thereof for allowing movement of said inner and outer parts over a door knob shaft, said outer part further having flanges extending past said back wall of said outer part for minimizing the space between said outer part and a door; and a lock and key mechanism for locking said inner and outer parts in a nested position.

2. The door knob guard of claim 1, wherein said lock and key mechanism comprises:

a rotating arm type lock mounted in said outer part; and a tab within said inner part, said tab being an integral part of said inner part.

* * * * *